United States Patent [19]

Kistner

[11] 4,010,945

[45] Mar. 8, 1977

[54] CONTINUOUS FEEDER

[75] Inventor: Hermann Kistner, Tamm, Germany

[73] Assignee: Maschinenbau Oppenweiler GmbH, Oppenweiler, Germany

[22] Filed: Feb. 6, 1976

[21] Appl. No.: 656,077

[30] Foreign Application Priority Data

Feb. 7, 1975 Germany ..... 2505164
May 16, 1975 Germany ..... 2521849

[52] U.S. Cl. ..... 271/151; 271/3.1; 271/31; 271/38; 271/225

[51] Int. Cl.[2] ..... B65H 1/22; B65H 3/10; B65H 7/02

[58] Field of Search ..... 271/3.1, 30 R, 31, 37, 271/38, 126, 127, 151, 152, 171, 185, 186, 225, 275

[56] References Cited

FOREIGN PATENTS OR APPLICATIONS 392,119 5/1933 United Kingdom ..... 271/37

*Primary Examiner*—Robert W. Saifer
*Attorney, Agent, or Firm*—Wigman & Cohen

[57] ABSTRACT

This disclosure relates to a continuous sheet feeder in which a stack of sheets arranged sheet-by-sheet are transported by conveyor belts from a lower loading tray, around a reversing cylinder and onto a discharge tray. In the region of the discharge tray, the conveyer passes between two guide rollers the longitudinal axes of which are arranged parallel to the axis of rotation of the reversing cylinder. The two guide rollers in the discharge tray are laterally movable with respect to each other whereby the inclination of the stack of sheets resting in the discharge tray can be automatically adjusted so that the upper sheet in the stack is always maintained in a horizontal disposition regardless of the format or size of the sheets, or their sheet-by-sheet arrangement.

14 Claims, 5 Drawing Figures

CONTINUOUS FEEDER

BACKGROUND OF THE INVENTION

This invention relates to a circular stack sheet feeder with a lower loading tray, on which stacks of sheets arranged sheet-by-sheet can be loaded, comprising a conveying and reversing device, which transports the stacks arranged sheet-by-sheet in a first conveying direction to the lower side of a reversing cylinder and, with the help of the reversing cylinder, around this cylinder towards the top and, in a second conveying direction, onto a discharge tray over which at least one flexibly stretched conveyer belt is led, running in the second conveying direction, which passes between two rollers, arranged paraxially to the reversing cylinder, and with separating means which always pull the upper sheet of the stack vertically to the conveying direction of the conveyer belt.

Prior art circular stack sheet feeders of this kind actually have the advantage, in comparison with those where the separating means always move the upper sheet across the entire loading tray, that the loading tray is not only accessible from the two sides running in the conveying direction but also from the side running laterally thereto. However, this known circular stack feeder has the disadvantage that the upper sheet of the stack on the discharge tray will be maintained in a horizontal plane only for one predetermined sheet format or size and sheet-by-sheet arrangement. In this regard it should be understood that a horizontal disposition of the upper sheet is necessary for a safe functioning of the sheet separating device, as well as to accommodate the conveyer line which extends in the conveying direction. Consequently, the prior art sheet feeders of this type cannot be utilized under conditions where it is necessary to feed sheets of varying format and arrangement, such as in connection with a folding machine, because such sheets which differ in size or arrangement from the predetermined criteria will assume an inclined disposition in the discharge tray rather than the necessary horizontal disposition.

SUMMARY OF THE INVENTION

The invention is based on the objective to improve a circular stack sheet feeder of the above-mentioned type in such a way that a certain position of the upper sheet, independently of the sheet format and of the sheet-by-sheet arrangement of the stack, is guaranteed. This objective is reached in accordance with the invention in such a way that the conveyer belt running across the discharge tray follows a path which is automatically adjusted to the form of the sheet-by-sheet arrangement of the stack in the section of the discharge tray where the sheets are resting and that the two rollers are adjustable laterally to their center of rotation while maintaining their set height whereby the lower side of the roller closer to the reversing cylinder and the upper side of the other one, within the area of the roller arranged at the end of the discharge tray away from the reversing cylinder, define the plane in which the upper sheet will come to rest.

By means of such an arrangement and adjustment of the two rollers and in connection with the automatic adjustment, to the form of the sheet-by-sheet stack, of the path of the conveyer belt, the sheet stack resting on the discharge tray can be arranged, independently of the sheet format and of a narrow and wide sheet-by-sheet stacking, in such a way that the upper sheet is in the desired position.

In order to simplify the adjustment of the two rollers as much as possible, an adjustment gear moving both rollers to the same extent and in opposite directions is provided in the case of the most preferable design. In this instance, the two rollers are appropriately and symmetrically arranged with reference to the median plane of the discharge tray so that the separating means do not have to be adjusted with the changing of the sheet format or the sheet-by-sheet stacking arrangement in order to always seize the sheets within the area of their center line.

An automatic adjustment of the path of the conveyer belt in the area of the discharge tray can be achieved by means of a supportless guide within the section forming the area for the resting of the stack on the discharge tray. However, in the case of a preferable design, the conveyer belt is supported by a support, level in the conveying direction, within the discharge area between the two rollers. This rigid support is pivoted at the end adjacent to the second roller around an axle located in its center of rotation or parallel to its center of rotation and which is seized by at least one pre-tensioned spring which biases toward the first roller. Such a support assures, in case of relatively heavy stacks of sheets, that the conveyer belt runs in a straight line within the area of the ragged end of the stack of sheets. In this way, it is also assured that the ragged end is placed in a plane which is the pre-condition for the correct positioning of the upper sheet. The pivoting of the support by the spring makes the automatic adjustment of the conveyer belt to the correct inclination possible.

Since, as a rule, the discharge tray is arranged as closely as possible to the reversing cylinder to economize space, the space available for the support is restricted. In the case of a preferable design, the support is, therefore, adjustable in length. It can then be adjusted to the space available and necessary.

In the case of a preferable design, the support is made of a plate with seams running in the conveying direction which give the plate a favorable relationship between weight and carrying capacity.

Since, in the case of comparatively heavy stacks of sheets, the conveyer belts which transport the sheets from the loading tray to the reversing cylinder are, in spite of a relatively high tension, not in a position to hold the stack of sheets in a common plane, it is appropriate to support the conveyer belts within this area by means of a rigid supporting plate or the like. So that this supporting plate can adjust to the different stacks of sheets, it is expedient to pivot it around an axis lateral to the conveying direction at the end towards the loading tray. Furthermore, at least one spring, biasing the other end of the supporting plate towards the reversing cylinder, is provided. In this manner, the supporting plate can automatically adjust to different stacks of sheets.

With the above and other objects in view that may become apparent hereinafter, the nature of the invention will be more clearly understood by reference to the several views illustrated in the attached drawings, the following detailed description thereof, and the appended claimed subject matter; wherein:

DETAILED DESCRIPTION OF PREFERRED EMBODIMENTS

Figure 1:
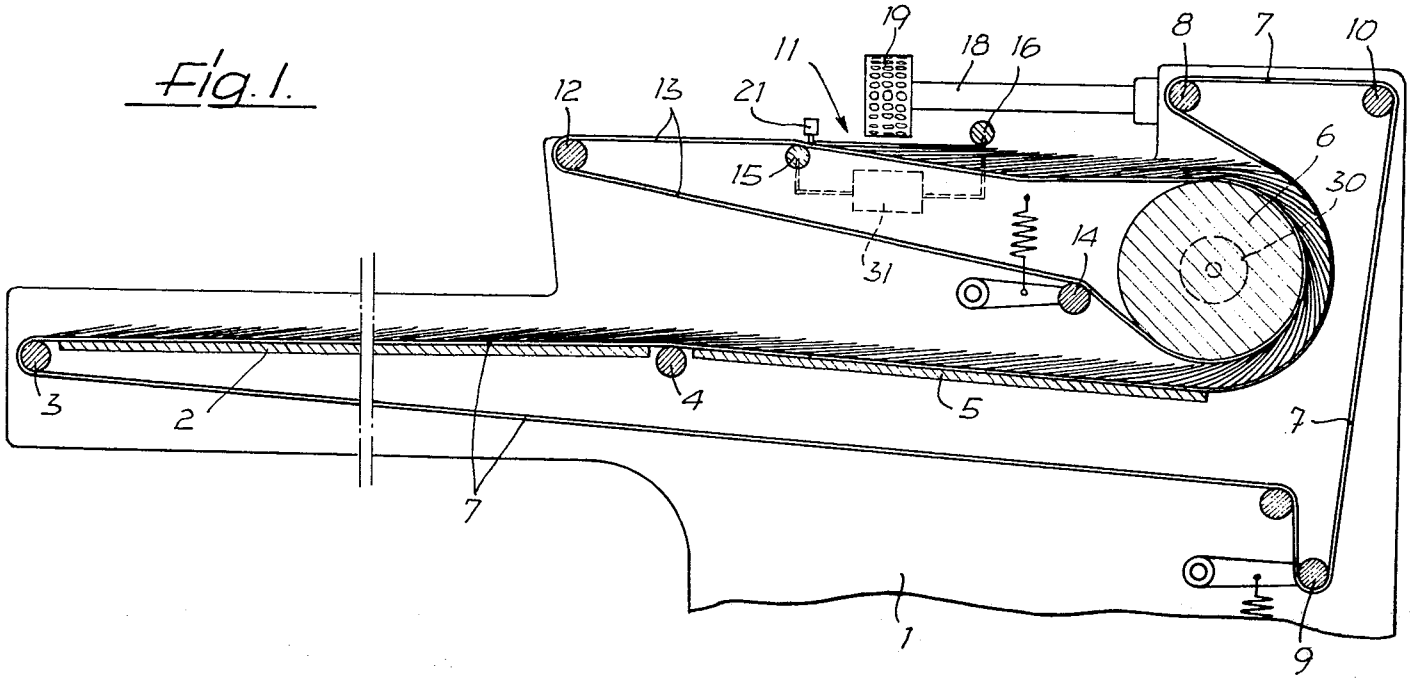
FIG. 1 is a generally schematic elevation view of a first embodiment of the continuous feeder constructed in accordance with this invention, and illustrates the guide rollers in the discharge tray adjusted for sheets of a short format.

Referring now to the drawings in detail, there is illustrated in FIG. 1 a circular stack sheet feeder constructed in accordance with a first embodiment of this invention. The circular stack sheet feeder, by means of which sheets can be supplied individually to a processing machine, particularly to a folding machine, includes a machine frame 1 which carries a loading tray 2 projecting over the frame being thus accessible from three sides. The free end of the loading tray 2 is formed by a first guide roller 3, the opposite end by a second guide roller 4. To the latter guide roller 4, a supporting plate 5 is attached which ends below a reversing cylinder 6, pivotally mounted in the machine frame 1. The axle of the reversing cylinder 6, coupled to a schematically shown drive 30, is in parallel to the axles of the guide rollers 3 and 4. Several conveyer belts 7, arranged next to each other, run over the two guide rollers 3 and 4 as well as the supporting plate 5 and are then led around the reversing cylinder 6 up to a third guide roller 8, arranged above the guide roller from where the conveyer belts 7 are led back to the first guide roller 3 over two additional guide rollers 9 and 10, the first of which is designed as a tension roller and the latter as a drive roller.

At a distance above the supporting plate 5, at a height which corresponds to the height of the transporting path to the subsequent processing machine, a discharge tray 11 is arranged whose free end, formed by a guide roller 12, is above the edge of the loading tray so that the latter is still easily accessible from above. Several conveyer belts 13, arranged next to each other, are led over the guide roller 12. These conveyer belts 13 run from the guide roller 12 to the reversing cylinder 6, go around it, are then led over a spring-loaded tension roller 14 and go again back from there to the guide roller 12. These conveyer belts 13 form the surface of the discharge tray 11. Furthermore, the discharge tray 11 has two rollers 15 and 16, arranged in a longitudinal direction of the conveyer belts 13 in a staggered manner, whose axes are parallel to the axes of the guide roller 12 and of the reversing cylinder 6. The upper side of the roller 15 being located closer to the guide roller 12 and the lower side of the roller 16 being located closer to the reversing cylinder 6 are in that plane in which the upper sheet of the stack arranged sheet-by-sheet should be placed for being transported from the loading tray 2 to the discharge tray 11 by means of the conveyer belts 7 and 13.

The two rollers 15 and 16 cannot only be rotated but can also be shifted transversely to their longitudinal axes in the plane defined by them for the upper sheet and, in the disclosed embodiment, in a positive manner to the same degree and in opposite directions. This is achieved by a schematically shown control gear 31.

FIG. 1 illustrates the adjustment of the two rollers 15 and 16 for sheets of a short format. The roller 15, over which the conveyer belts 13 run and from which they are led to the reversing cylinder 6 without any support, is, in this instance, aligned to the front edge of the upper sheet as viewed in the transporting direction of the conveyer belts 13, and the roller 16 aligned to the rear edge. Consequently, an adjustment of the two rollers 15 and 16 in connection with the adjustability of the course of the conveyer belts 13, within the area between the roller 15 and the reversing cylinder 6, to the form of the stack of sheets, the position of the upper sheet of the sheets resting on the discharge tray 11 in the desired plane is achieved.

The two rollers 15 and 16 are adjusted in such a manner that they are symmetrically aligned to the center line of the discharge tray 11 and to the subsequent transport path.

As a drawing-off device, a suction wheel 19 is provided in the disclosed embodiment, the center of rotation of which extends in the conveying direction of the conveyer belts 13, so that the sheets are drawn-off the discharge tray 11 transversely to the direction in which they are supplied to it. By means of a carrying arm 18, the suction wheel 19 is held, at a slight distance, above the plane defined by the upper side of the roller 15 and the lower side of the roller 16 above the edge of the upper sheet and in a position aligned with the center line of the discharge tray 11.

The control of the drive of the reversing cylinder 6 and of the guide roller 10 is effected by means of a sensing element 21 which can be shifted together with the roller 15. This sensing element 21 stops the drive and thus the conveyer belts 7 and 13 as soon as the front edge of the top sheet of the sheets transported to the discharge tray 11 is sensed. As soon as the suction wheel 19 has seized the upper sheet, the conveyer belts 7 and 13 are again started. The suction wheel 19 is controlled by a control device preferably operating with light barriers and this device issues the control commands on the basis of the position of the sheets transported by the suction wheel. Therefore, the control device stops the suction wheel 19 when the seized sheet has been transported sufficiently far, and starts it again when this sheet, which is subsequently taken over by an additional conveying device, is a desired distance from the following sheet.

Figure 2:
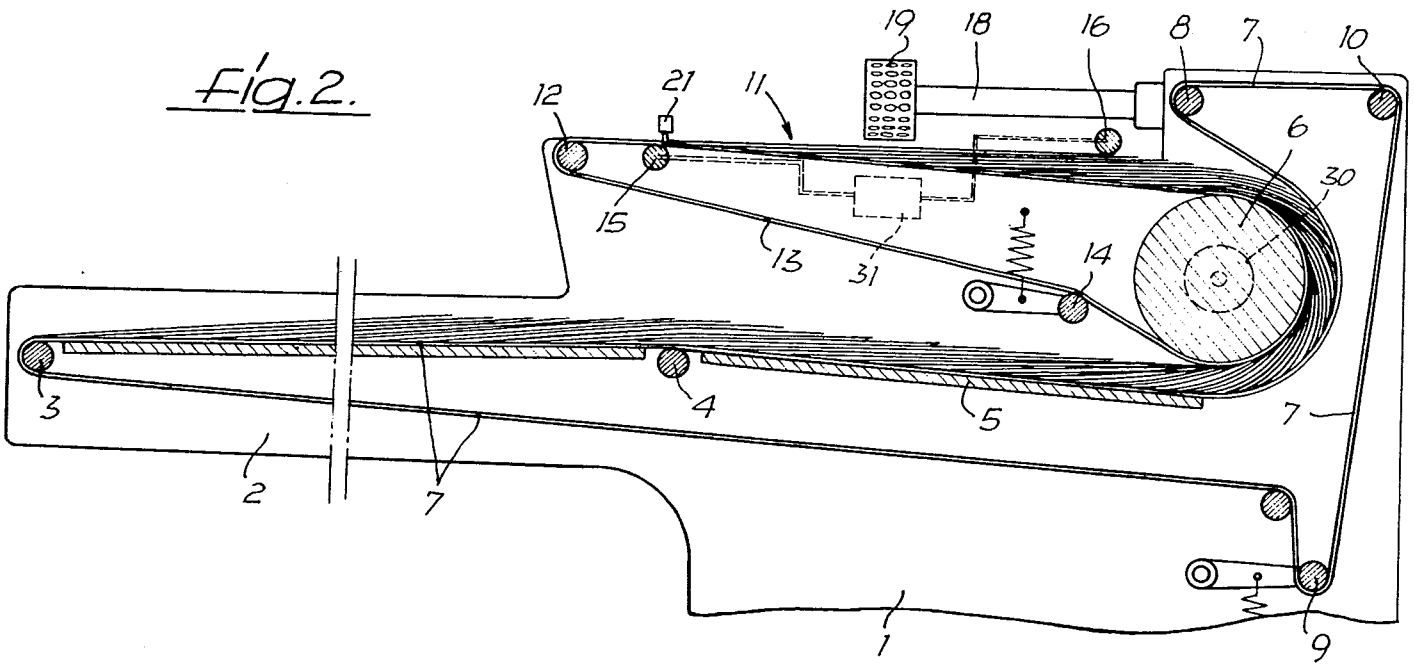
FIG. 2 is a generally schematic elevation view of the continuous feeder of FIG. 1, and illustrates the guide rollers adjusted for a sheet of longer format.

For sheets with a relatively long format, the distance of the two rollers 15 and 16 from each other is correspondingly dimensioned as is shown in FIG. 2. This figure also shows clearly how the conveyer belts 13 are capable of adjusting to the inclination of the stack of sheets resting on the discharge tray 11.

Figure 3:
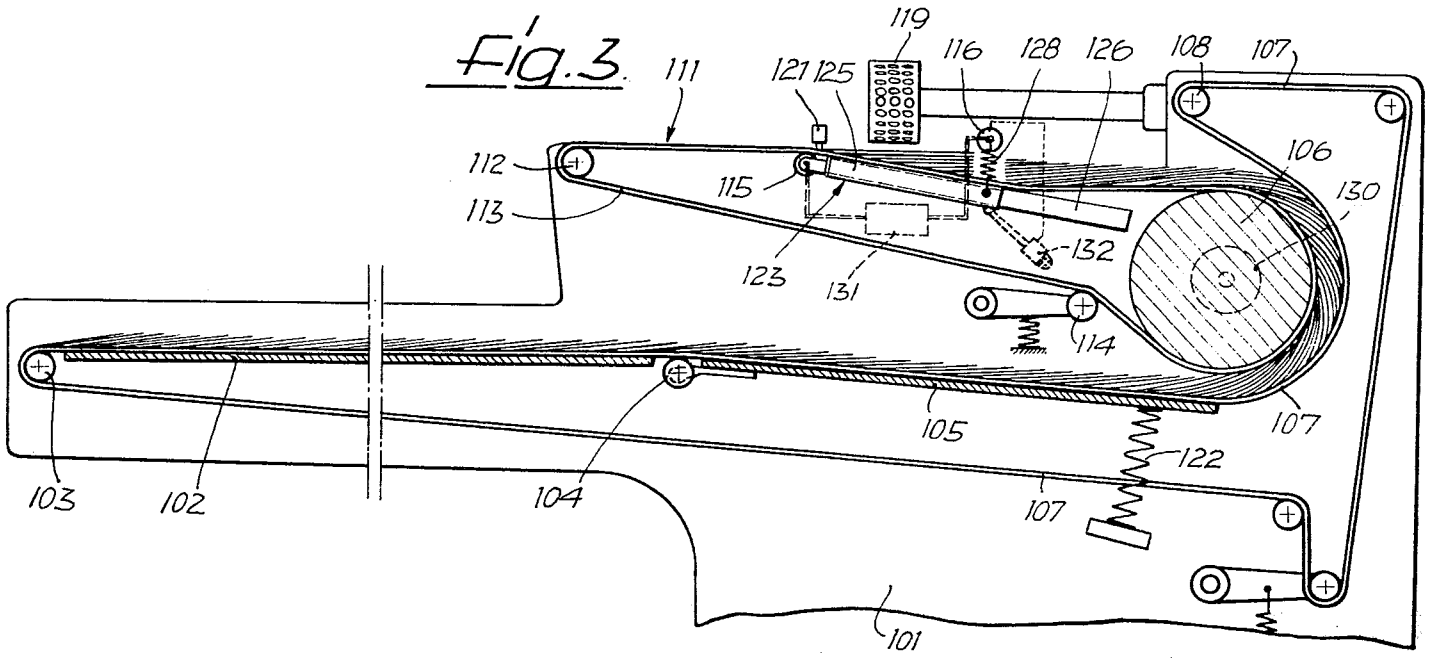
FIG. 3 is a generally schematic elevation view of a second embodiment of a continuous feeder constructed in accordance with this invention, and illustrates the guide rollers adjusted for a sheet of short format.
Figure 4:
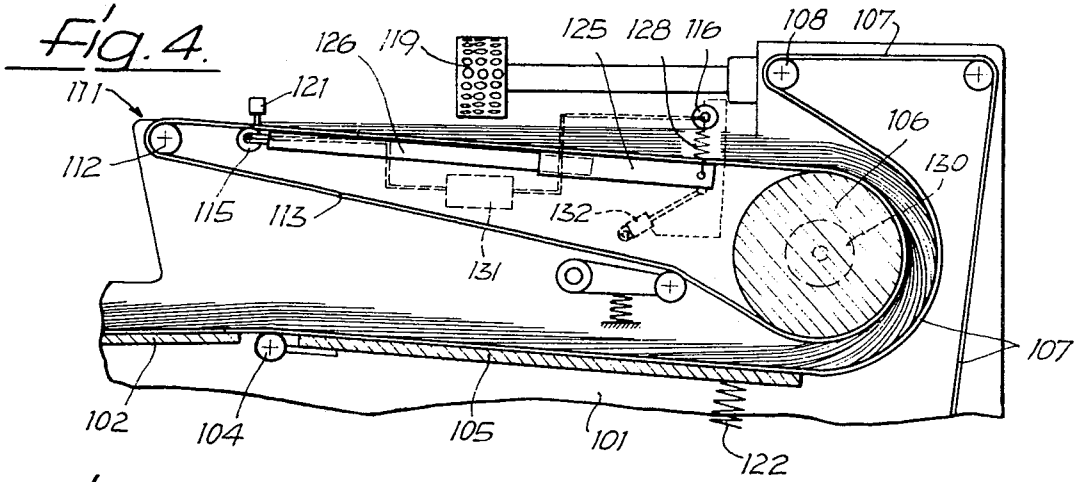
FIG. 4 is a generally schematic elevation view of the continuous feeder of FIG. 3, and illustrates the guide rollers adjusted for a sheet of longer format.
Figure 5:
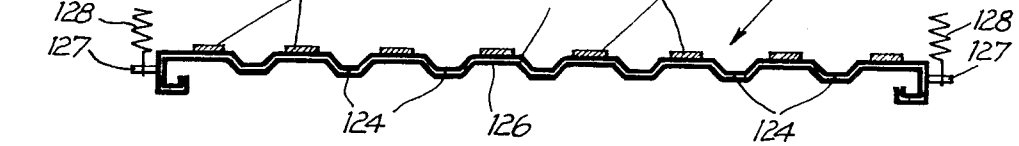
FIG. 5 is a sectional view taken through the conveyer support in the discharge tray of the apparatus of FIGS. 3 and 4.

The second embodiment as shown in FIGS. 3 to 5 corresponds partially with the first embodiment according to FIGS. 1 and 2. Those parts which correspond with parts of the first embodiment are, therefore, given reference numbers which are larger by 100. Furthermore, the explanation is restricted to the different characteristics because the explantions for the first embodiment are also applicable to the other characteristics.

A rigid supporting plate 105 follows the second guide roller 104 forming the end of the loading tray 102. This supporting plate 105 ends below the reversing cylinder 106 and is provided around an axis transversely to the conveying direction at the end adjacent to the guide roller 104. In the disclosed embodiment, this axis of rotation coincides with the rotating axis of the guide roller 104. Near the end of the supporting plate 105, below the reversing cylinder 106, at least one pre-tensioned pressure spring 122 acts upon the lower part of the supporting plate 105. This pressure spring 122 rests with its other end on the machine frame 101. The tension of this pressure spring 122 is chosen in such a way that the supporting plate remains attached to the conveyer belts 107 along its entire length.

The conveyer belts 113 are supported by a rigid carrier plate 123 forming a plane resting surface for all conveyer belts 113 within the area between the two rollers 115 and 116. This assures that the belts 113 will all run in a common plane in this area, and also that the ragged end of the stack in this area will be in the same plane regardless of the weight of the stack.

The carrier plate 123 has, as is shown in FIG. 5, seams 124 running in the longitudinal direction of the conveyer belts 113 which effect a reinforcement of the carrier plate as well as a reduction of the supporting surface for the zones necessary for the conveyer belts 113. The stack of sheets rests, therefore, only on the conveyer belts in spite of the support of the conveyer belts 113 by the supporting plate 123.

The supporting plate 123, extending across the entire width of the discharge tray 111, consists of two partial plates 125 and 126 which can be shifted relatively towards each other in the longitudinal direction of the conveyer belts 113 and which are guided in each other. For this purpose, as is shown in FIG. 5, the partial plates 125 and 126 have such a profile that the seams of the one partial plate interlock with the seams of the other one. Furthermore, the two edge zones of the upper partial plate 125 are beveled first towards the bottom, then towards the inside and towards the top. The correspondingly beveled edge zones of the lower partial plate 126 are guided in these two C-shaped guides so that both partial plates 125 and 126 can only be shifted relatively towards each other in the longitudinal direction of the conveyer belts 113.

As is shown in FIGS. 3 and 4, the end of the partial plate 126 adjacent to the roller 115 is pivoted around an axis transverse to the conveying direction of the conveyer belts 113 and, in the disclosed embodiment, on the axis of the roller 115. Furthermore, at the area bent towards the bottom of the partial plate 125 near the end facing the reversing cylinder 108, a fastening element 127 is provided on both sides for a tension spring 128, the other end of which is suspended at the axle of the second roller 116 placed above the fastening elements. The strength of the tension spring 128 is chosen in such a way that the conveyer belts 113 rest always on the entire area of the end of the stack of sheets, i.e., between the roller 115 and that point where the path of the conveyer belts 113 bends.

The length of the two partial plates 125 and 126 is different. The length of the partial plate 125 is about the same as the distance between the two rollers 115 and 116 when adjusted for the smallest sheet format (see FIG. 3). The length of the partial plate 126 is a little less than the distance of the roller 115 from the reversing cylinder 106 when adjusted for the smallest sheet format. As FIG. 4 shows, this results in a maximum length of the carrier plate 123 which is sufficient to support the conveyer belts 113, also when adjusted for the largest sheet format, across the entire section resting on the end of the stack of sheets.

Owing to the support of the conveyer belts 113 by means of the supporting plate 123, the conveyer belts 113 hold the end of the stack, within the area of the discharge tray 111, always in a plane with the correct inclination relative to the upper sheet so that this is kept in the desired position with regard to the drawing-off device 119, the center of rotation of which extends in the conveying direction of the conveyer belts 113 so that the sheet can be drawn off the discharge tray transversely to the direction in which it was supplied to the discharge tray.

Instead of using the tension spring 128, the supporting plate 123 can also be given the correct inclined position by means of an adjusting device 131 driven by a motor. Such an adjusting device, which carries the supporting plate 123 in the manner shown in FIGS. 3 and 4, could be controlled by means of a sensor which, depending on the pressure exercised by the stack on the roller 116, starts the motor of the adjusting device in either direction of rotation and thus effects a lifting or lowering of the end of the supporting plate 123 pointing toward the reversing cylinder 106 when the pressure is too high or too low, respectively, and stops the motor when the desired value of the pressure is reached. Such an adjusting device has the advantage, in comparison with a spring, that, independent of the weight of the stack, the pressure which the stack exercises on the roller 116 can be kept at a constant level.

Although only preferred embodiments of the invention have been specifically illustrated and described herein, it is to be understood that minor modifications could be made therein without departing from the spirit and scope of the invention as defined in the appended claims.

I claim:

1. A circular stack sheet feeder comprising a lower loading tray upon which stacks of sheets having a sheet-by-sheet arrangement can be loaded, a conveying and reversing device for transporting the sheets from said loading tray onto a discharge tray in an inverted disposition, said device including a rotatable reversing cylinder having upper and lower sides, means for conveying sheets in a first direction toward the lower side of said cylinder, around said cylinder to the upper side thereof and then in a second direction onto said discharge tray, said means for conveying in said second direction including at least one flexibly stretched conveyer belt which extends over said discharge tray and which is adapted to assume an inclination, at least in the region of said discharge tray, which deviates from the horizontal as a function of the size and weight of the stack of sheets disposed thereon, separating means for drawing off the upper sheet of the stack disposed on said discharge tray, means for automatically adjusting the inclination of said conveyer belt so that the upper sheet of the stack disposed on said discharge tray will always be maintained in substantially horizontal plane thereby facilitating withdrawal by said separating means, first and second rollers extending transversely to said conveyer belt and defining a sheet removal zone therebetween in said discharge tray, said first roller being disposed above said belt and adapted to bear upon the upper sheet in said stack and said second roller being supportingly disposed below said belt, and wherein said means for automatically adjusting the inclination of said conveyer belt includes means for varying the distance between said first and second rollers.

2. A circular stack sheet feeder as defined in claim 1, wherein said distance varying means comprises a control gear for moving both of said rollers to the same degree and in opposite directions.

3. A circular stack sheet feeder as defined in claim 1, wherein each of said rollers have upper and lower surfaces, the lower surface of said first roller and the upper surface of said second roller being substantially coextensive in a common horizontal plane, and means for maintaining said surfaces in said plane regardless of the distance therebetween.

4. A circular stack sheet feeder as defined in claim 1, further including a third roller defining an end of said discharge tray, and wherein said first and second rollers are disposed between said third roller and said reversing cylinder.

5. A circular stack sheet feeder as defined in claim 1, wherein said conveyer belt is unsupported in said discharge tray in the region thereof where said stack of sheets is disposed.

6. A circular stack sheet feeder as defined in claim 1, wherein said conveyer belt is supported between said first and second rollers by a rigid support which is pivotally mounted at one end adjacent said second roller, and resilient means biasing the other end of said support toward said first roller.

7. A circular stack sheet feeder as defined in claim 6, said support being adjustable in length in the conveying direction.

8. A circular stack sheet feeder as defined in claim 7, said support consisting of two parts of different lengths which can be shifted relatively towards each other in the conveying direction and are guided within each other, the first part being longer and pivoted at its one end, and a pretensioned spring biasing the second part.

9. A circular stack sheet feeder as defined in claim 8, the length of the first part of the support being shorter than the smallest possible distance of the second roller from the reversing cylinder, and the length of the second part being about equal to the smallest possible distance of the two rollers from each other.

10. A circular stack sheet feeder as defined in claim 6, wherein the support extends across the entire width of the discharge tray.

11. A circular stack sheet feeder as defined in claim 6, wherein the support is designed as a plate with seams running in the conveying direction.

12. A circular stack sheet feeder as defined in claim 1, wherein said means for conveying sheets in a first direction includes at least one conveyer belt supported by a supporting plate extending between said loading tray and said reversing cylinder, said supporting plate being pivotally mounted at one end thereof adjacent said loading tray, and resilient means biasing the other end of said plate toward said reversing cylinder.

13. A circular stack sheet feeder as defined in claim 12, wherein said resilient means is a compression spring.

14. A circular stack sheet feeder comprising a lower loading tray upon which stacks of sheets having a sheet-by-sheet arrangement can be loaded, a conveying and reversing device for transporting the sheets from said loading tray onto a discharge tray in an inverted disposition, said device including a rotatable reversing cylinder having upper and lower sides, means for conveying sheets in a first direction toward the lower side of said cylinder, around said cylinder to the upper side thereof and then in a second direction onto said discharge tray, said means for conveying in said second direction including at least one flexibly stretched conveyer belt which extends over said discharge tray and which is adapted to assume an inclination, at least in the region of said discharge tray, which deviates from the horizontal as a function of the size and weight of the stack of sheets disposed thereon, separating means for drawing off the upper sheet of the stack disposed on said discharge tray, means for automatically adjusting the inclination of said conveyer belt so that the upper sheet of the stack disposed on said discharge tray will always be maintained in a substantially horizontal plane thereby facilitating withdrawal by said separating means, and wherein said conveyer belt is unsupported in said discharge tray in the region thereof where said stack of sheets is disposed.

* * * * *